US011176897B2

(12) United States Patent
Kang

(10) Patent No.: US 11,176,897 B2
(45) Date of Patent: Nov. 16, 2021

(54) DRIVING METHOD FOR LIQUID CRYSTAL DISPLAY PANEL, DRIVING DEVICE AND DISPLAY APPARATUS

(71) Applicants: HKC Corporation Limited, Shenzhen (CN); Chongqing HKC Optoelectronics Technoology Co.., Ltd., Chongqing (CN)

(72) Inventor: Chih-Tsung Kang, Chongqing (CN)

(73) Assignee: HKC CORPORATION LIMITED, Shenzhen (CN)

( * ) Notice: Subject to any disclaimer, the term of this patent is extended or adjusted under 35 U.S.C. 154(b) by 750 days.

(21) Appl. No.: 16/064,358

(22) PCT Filed: Jan. 24, 2018

(86) PCT No.: PCT/CN2018/073933
§ 371 (c)(1),
(2) Date: Jun. 20, 2018

(87) PCT Pub. No.: WO2019/119606
PCT Pub. Date: Jun. 27, 2019

(65) Prior Publication Data

US 2021/0210031 A1 Jul. 8, 2021

(30) Foreign Application Priority Data

Dec. 21, 2017 (CN) ..... 201711394004.2

(51) Int. Cl.
*G09G 3/36* (2006.01)

(52) U.S. Cl.
CPC ... *G09G 3/3607* (2013.01); *G09G 2300/0452* (2013.01); *G09G 2320/0233* (2013.01); *G09G 2320/0673* (2013.01); *G09G 2360/16* (2013.01)

(58) Field of Classification Search
CPC ..... G09G 3/3607; G09G 2300/0452; G09G 2320/0233; G09G 2320/0673; G09G 2360/16
See application file for complete search history.

(56) References Cited

U.S. PATENT DOCUMENTS

2012/0287147 A1 11/2012 Brown Elliott et al.
2018/0174535 A1* 6/2018 Chen ..... G09G 3/007

FOREIGN PATENT DOCUMENTS

CN 104317084 A 1/2015
CN 105304028 A 2/2016
(Continued)

OTHER PUBLICATIONS

International Search Report dated Aug. 15, 2018, in the corresponding PCT application PCT/CN2017/073933, 9 pages in Chinese.

*Primary Examiner* — Kenneth B Lee, Jr.
(74) *Attorney, Agent, or Firm* — Juan Carlos A. Marquez; Marquez IP Law Office, PLLC

(57) ABSTRACT

A driving method includes: calculating average image signals of sub-pixels of a division area to generate an average value of red color signals of the division area, an average value of green color signals of the division area, and an average value of blue color signals of the division area. And then, executing a red color gamma adjustment and blue color gamma adjustment respectively according to a predefined frame determining with the corresponding a plurality of gray levels of the average value of red color signals of the division area, the average value of green color signals of the division area, and the average value of blue color signals of the division area.

17 Claims, 5 Drawing Sheets

(56) References Cited

FOREIGN PATENT DOCUMENTS

| | | | |
|---|---|---|---|
| CN | 107154240 | A | 9/2017 |
| JP | 2010072353 | A | 4/2010 |

* cited by examiner

DRIVING METHOD FOR LIQUID CRYSTAL DISPLAY PANEL, DRIVING DEVICE AND DISPLAY APPARATUS

FIELD OF THE INVENTION

The present invention relates to a liquid crystal display panel, and more particularly, to a driving method of the liquid crystal display panel and a driving device using the same, and a display apparatus suitable for employing the driving device thereof.

BACKGROUND OF THE INVENTION

The liquid crystal display is a flat thin display apparatus, and is composed of a certain number of colorful or black and white pixels placing in front of a light source or a reflecting surface. Each pixel consists of a series of liquid crystal molecules suspended between two transparent electrodes, and two polarization filter pieces with two polarization directions perpendicular to each other are arranged on the outer sides of the two transparent electrodes. If there are no liquid crystal molecules disposed between the electrodes, the light passes through one of the polarization filter pieces whose polarization direction will be completely perpendicular to the second polarization filter piece and is therefore completely blocked. However, if the light ray is rotated by the liquid crystal molecules through the polarization direction of a polarization filter piece, it can pass through another polarization filter piece. The rotation of the liquid crystal molecules in the direction of polarization of the light ray can be controlled by the electrostatic field, so as to realize the control of light ray.

Before the electric field is applied to the transparent electrode, the arrangement of the liquid crystal molecules is determined by the arrangement of the electrode surface, and the chemical substance of the surface of the electrode can be used as crystal seed of the liquid crystal molecules. In the most common twisted nematic (TN) liquid crystal type, the axes of the liquid crystal molecules are vertically arranged with the upper and lower electrodes in the condition of applied with the electric field. The liquid crystal molecules are arranged in a spiral, and the light ray passing through a polarization filter piece is rotated in the direction of polarization after passing through the liquid crystal layer, so that the light ray can pass through the other polarization filter piece. In the process, a small part of light rays is blocked by the polarization filter pieces and therefore appear grey from outside. After the electric power is applied to the transparent electrodes, the liquid crystal molecules are almost completely arranged in parallel along the direction of the electric field, so that the light rays penetrating through one polarization filter piece do not rotate in the polarization direction, therefore the light rays are completely blocked and at the moment, the image pixels appear to be black. By controlling the voltage applied to the transparent electrodes, the degree of twist of the arrangement of the liquid crystal molecules can be controlled, so that different grey levels can be achieved.

Due to the fact that no color exists in the liquid crystal molecules, various colors are generated by the color filter and therefore the color filter is a key component for changing the gray levels into colorful displaying of the liquid crystal display panel. Besides, a light source is provided by a backlight module inside the LCD, and then a gray level displaying is formed by matching the driving IC with the liquid crystal molecules, and the light source penetrates through the colored resist layer of the color filter to form a colorful displaying screen.

In addition, the wide viewing angle technology is one of the developing focuses of the liquid crystal display at present. However, if a side viewing angle or an oblique viewing angle is too large, color shift phenomenon may occur in the wide viewing angle display apparatus.

SUMMARY OF THE INVENTION

The colored resist layer of the color filter deployed in liquid crystal display panel is commonly composed of two types of a red, a green and a blue, i.e., so-called three primary color model, or a cyan, a magenta, and a yellow, i.e., so-called CMY color model.

Because of the liquid crystal display panel has the characteristics of correlation between the refractive index and the wavelength, moreover, the different wavelength transmittances of light ray are related to phase delay, therefore the displaying of display panel having different degrees of performance pertain to the transmittance and the wavelength of light ray. Furthermore, along with the driving of voltage to generate different wavelength phase delay it can effect the transmittance performance of liquid crystal display panel.

In order to solve the aforementioned problem, it is an object of the present invention to provide a driving method for a display apparatus. The driving method includes the steps of calculating average image signals of sub-pixels of a division area to generate an average value of red color signals of the division area, an average value of green color signals of the division area, and an average value of blue color signals of the division area; executing a red color gamma adjustment and blue color gamma adjustment respectively according to a predefined frame determining with the corresponding a plurality of gray levels of the average value of red color signals of the division area, the average value of green color signals of the division area, and the average value of blue color signals of the division area; and finally adjusting the brightness of a red light source and the brightness of a blue light source respectively.

In one embodiment of the present invention, when the gray level of the average value of green color signals of the division area in a first gray value of the predefined frame and, the gray level of the average value of red color signals of the division area and the gray level of the average value of blue color signals of the division area in a second gray value of the predefined frame, the red color gamma is adjusted from original $\gamma R$ to adjusted $\gamma R1$, the blue color gamma is adjusted from original $\gamma B$ to adjusted $\gamma B1$, and the adjusted $\gamma R1$ is greater than original $\gamma R$ ($\gamma R1>\gamma R$) and the adjusted $\gamma B1$ is greater than original $\gamma B$ ($\gamma B1>\gamma B$), where $\gamma$ represents gamma, R represents red color and B represents blue color.

In one embodiment of the present invention, the first gray value and the second gray value of the predefined frame are selected from one of the following groups:

- a first group including the the first gray value in a range of 255 to 200 and the second gray value in a range of 20 to 180;
- a second group including the the first gray value in a range of 200 to 150 and the second gray value in a range of 10 to 180;
- a third group including the the first gray value in a range of 150 to 100 and the second gray value in a range of 10 to 140;

a fourth group including the the first gray value in a range of 100 to 50 and the second gray value in a range of 10 to 80;

a fifth group including the the first gray value in a range of 50 to 0 and the second gray value in a range of 10 to 40.

In order to solve the aforementioned color shift problem of red, green and blue color hue, it is another object of the present invention to provide a driving device with use of a display apparatus including at least one division area composited of a plurality of pixel units, wherein each of the plurality of pixel units includes a red sub-pixel, a green sub-pixel, and a blue sub-pixel. The driving device comprises average value of signals computing means configured to calculate the average image signals of sub-pixels of a division area to generate an average value of red color signals of the division area, an average value of green color signals of the division area, and an average value of blue color signals of the division area; then, gamma signal transforming means configured to execute a red color gamma adjustment and blue color gamma adjustment respectively according to a predefined frame determining with the corresponding a plurality of gray levels of the average value of red color signals of the division area, the average value of green color signals of the division area, and the average value of blue color signals of the division area; and brightness adjusting means configured to adjust the brightness of a red light source and the brightness of a blue light source respectively.

In order to solve the aforementioned color shift problem of red, green and blue color hue, it is another object of the present invention to provide a display apparatus comprising a liquid crystal display panel and the aforementioned driving device, wherein the the driving device transmit the image signals to the liquid crystal display panel.

The method of driving gray levels of the present invention is used to improve the color shift problem of green color hue under the wide view angle prospect. The method of driving gray levels discloses in the present invention comprising calculating average image signals of sub-pixels of a division area to generate an average value of red color signals of the division area, an average value of green color signals of the division area, and an average value of blue color signals of the division area. And then, executing a red color gamma adjustment and blue color gamma adjustment respectively according to a predefined frame determining with the corresponding a plurality of gray levels of the average value of red color signals of the division area, the average value of green color signals of the division area, and the average value of blue color signals of the division area. Thereby, the red color and blue color input gamma signals are adjusted to be enlarged, so that the brightness ratio of red color and blue color relative to green color under the wide view angle prospect is further declined. Therefore, the green color hue under the wide view angle prospect is enhanced.

Furthermore, by using the compensation signal to adjust the brightness of a red light source and the brightness of a blue light source respectively, it can enable the chromaticity under the front viewing angle to maintain the same, without color shift, and consequently the original color expression cannot be influenced due to the adjustment of the red color gamma signal and the blue color gamma signal. With such configuration, the color shift of the liquid crystal panel may be reduced. Therefore, to maintain the original signal and having the same color performance can be achieved, also to keep an excellent viewing angle characteristic in the green color is enhanced at the same time.

Various other objects, advantages and features of the present invention will become readily apparent from the ensuing detailed description, and the novel features will be particularly pointed out in the appended claims.

BRIEF DESCRIPTION OF FIGURES

The following detailed descriptions, given by way of example, and not intended to limit the present invention solely thereto, will be best be understood in conjunction with the accompanying figures.

DETAILED DESCRIPTION OF THE EMBODIMENTS

Figure 1:
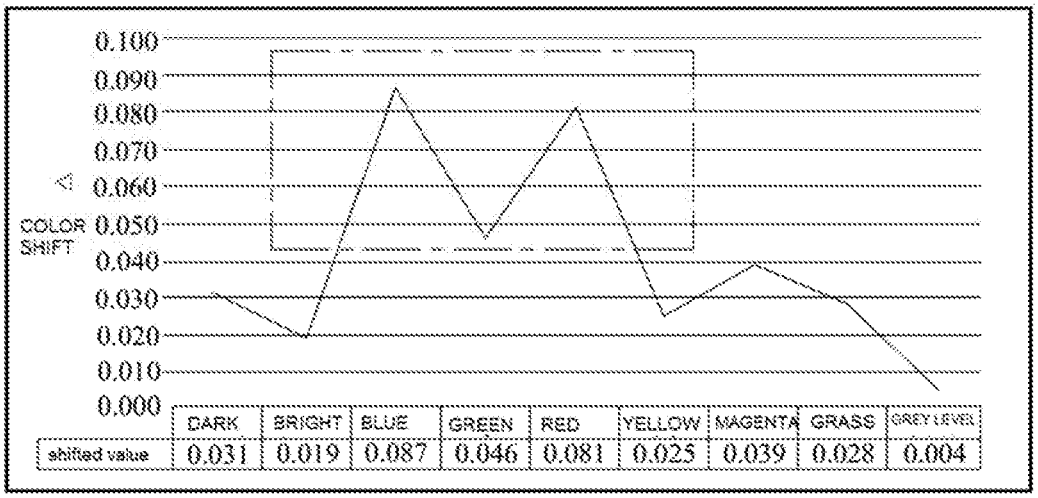
FIG. 1 is a graph illustrating basic colors of color spaces with respect to color shift before adjusting the signals of pixels of a liquid crystal display panel according to one embodiment of the present invention.

The following embodiments are referring to the accompanying drawings for exemplifying specific implementable embodiments of the present invention. Furthermore, directional terms described by the present invention, such as upper, lower, front, back, left, right, inner, outer, side and etc., are only directions by referring to the accompanying drawings, and thus the used directional terms are used to describe and understand the present invention, but the present invention is not limited thereto.

The drawings and description are to be regarded as illustrative in nature and not restrictive. Like reference numerals designate like elements throughout the specification. In addition, the size and thickness of each component shown in the drawings are arbitrarily shown for understanding and ease of description, but the present invention is not limited thereto.

In the drawings, the thickness of layers, films, panels, regions, etc., are exaggerated for clarity. In the drawings, for understanding and ease of description, the thicknesses of some layers and areas are exaggerated. It will be understood that, when an element such as a layer, film, region, or substrate is referred to as being "on" another element, it can be directly on the other element or intervening elements may also be present.

Furthermore, in the specification, "on" implies being positioned above or below a target element and does not imply being necessarily positioned on the top on the basis of a gravity direction.

For further explaining the technical means and efficacy of the present invention intended to file, the driving method for liquid crystal display panel, driving device and display apparatus including the embodiments, structures, features and effects thereof according to the present invention will be apparent from the following detailed description and accompanying drawings.

Referring to FIG. 1, FIG. 1 is a graph illustrating basic colors of color spaces with respect to color shift before adjusting the signals of pixels of a liquid crystal display panel according to one embodiment of the present invention. FIG. 1 shows the relation between the representative colors of two color space models and color shift of the liquid crystal display panel under large viewing angle, for example, 60 degree viewing angle. It can be obviously found in the use of red, green and blue three primary colors of the color space model under the large viewing angle, the color shift situation is more serious than that of other color space model. Therefore, to solve the red, green and blue color shift weaknesses can greatly eliminate the color difference from overall color appearances of the display panel under large viewing angle.

Figure 2:
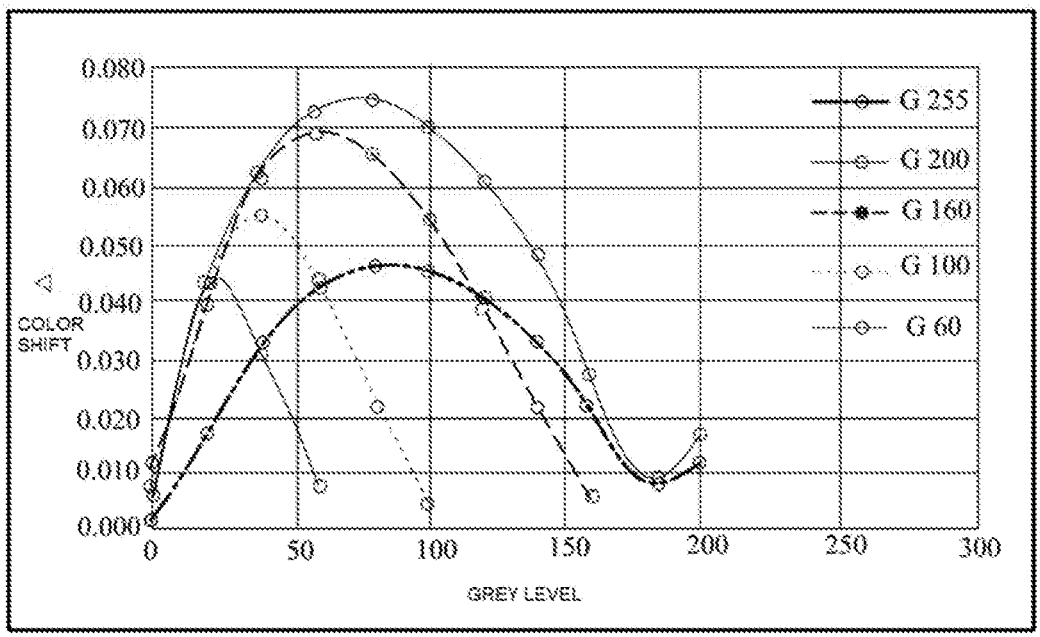
FIG. 2 is a graph illustrating the color shift of green color with respect to gray levels before adjusting the signals of pixels of a liquid crystal display panel according to one embodiment of the present invention.
Figure 7:
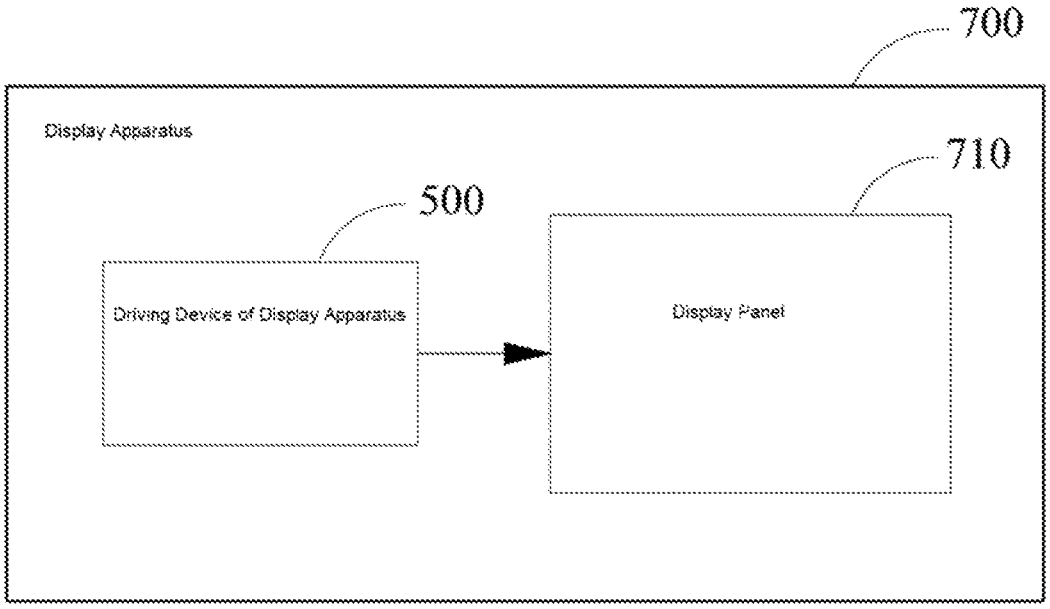
FIG. 7 is a block diagram of a display apparatus equipped with a driving device according to one embodiment of the present invention.

FIG. 2 is a graph illustrating the color shift of green color with respect to gray levels before adjusting the signals of pixels of a liquid crystal display panel according to one embodiment of the present invention. FIG. 7 is a block diagram of a display apparatus equipped with a driving device according to one embodiment of the present invention. As shown in FIG. 7, a display apparatus 700 includes a driving device 500 configured to transmit the image signals to the liquid crystal display panel 710. The color shift of color mixing of green color with respect to gray levels of the green color under front viewing angle or 60 degree viewing angle as shown in FIG. 2. Referring to FIG. 2 and FIG. 7 at the same time, when the gray level (Gray) of green color (G) is 255, the gray level of the red color (R) and blue color (B) is in a range of 20 to 180. Moreover, once the gray level signal of the red color or the blue color is lower, the color shift of the green hue is growing worse.

When the gray level (Gray) of green color (G) is 200, the gray level of the red color (R) and blue color (B) is in a range of 10 to 180, the gray level signal of the red color or the blue color is lower, the color shift of the green hue is growing worse.

When the gray level (Gray) of green color (G) is 160, the gray level of the red color (R) and blue color (B) is in a range of 10 to 140, the gray level signal of the red color or the blue color is lower, the color shift of the green hue is growing worse.

When the gray level (Gray) of green color (G) is 100, the gray level of the red color (R) and blue color (B) is in a range of 10 to 80, the gray level signal of the red color or the blue color is lower, the color shift of the green hue is growing worse.

Generally, when judging the relative brightness of different colors in well-lighted situations, humans tend to perceive light within the green parts of the spectrum as brighter than red or blue light under equal power. Moreover, the color shift issue may occur for the wide viewing angle images displayed by the display apparatus equipped with the function of wide viewing angle. The influence of the color shift can be illustrated with FIG. 3, FIG. 4 and the following description.

Figure 3:
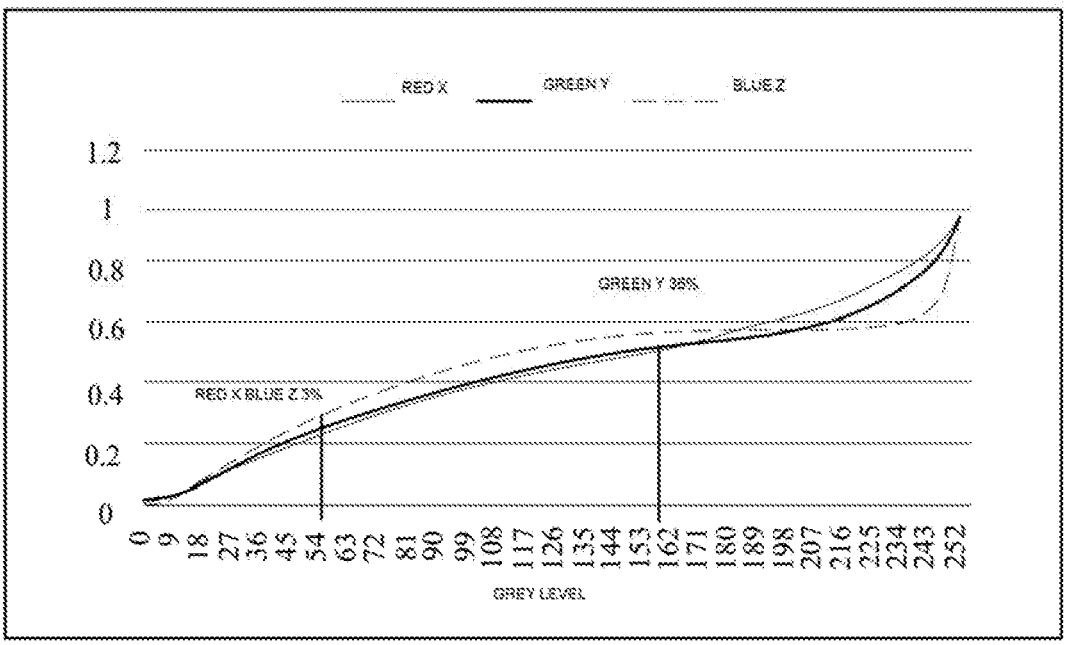
FIG. 3 is a graph illustrating the Red(X) of red color, the Green(Y) of green color and the Blue(Z) of blue color with respect to gray levels before adjusting the signals of pixels of a liquid crystal display panel under the front viewing angle according to one embodiment of the present invention.
Figure 4:
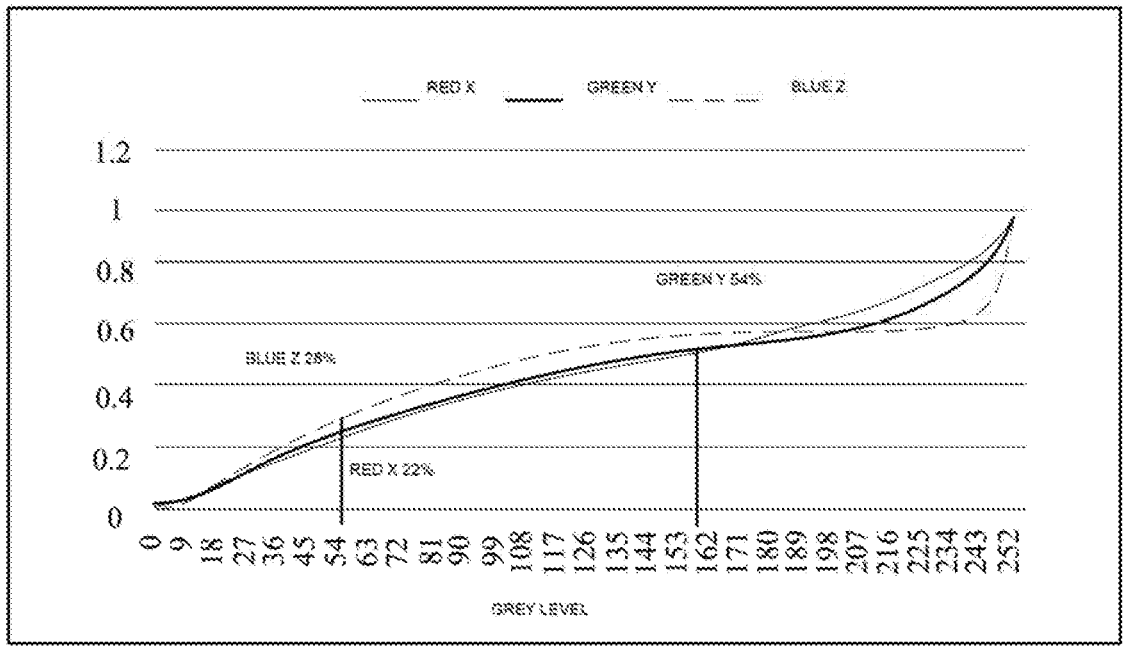
FIG. 4 is a graph illustrating the Red(X) of red color, the Green(Y) of green color and the Blue(Z) of blue color with respect to gray levels before adjusting the signals of pixels of a liquid crystal display panel under the wide viewing angle according to one embodiment of the present invention.

FIG. 3 is a graph illustrating the Red(X) of red color, the Green(Y) of green color and the Blue(Z) of blue color with respect to gray levels before adjusting the signals of pixels of a liquid crystal display panel under the front viewing angle according to one embodiment of the present invention. FIG. 4 is a graph illustrating the Red(X) of red color, the Green(Y) of green color and the Blue(Z) of blue color with respect to gray levels before adjusting the signals of pixels of a liquid crystal display panel under the wide viewing angle according to one embodiment of the present invention.

For example, in the conductions for under front viewing angle and the gray level of each color of the mixing colors compositing with red color, green color and blue color is red 50 gray level (R50), green 160 gray level (G160), and blue 50 gray level (B50). The corresponding gray level ratios of the red color R(X), the green color G(Y) and the blue color B(Z) with respect to full 255 gray level of red 255 gray level (R255), green 255 gray level (G255) and blue 255 gray level (G255) are 3%, 36% and 3% respectively. However, under wide viewing angle and the gray level of each color of the mixing colors compositing with red color, green color and blue color is the same with the aforementioned, the corresponding gray level ratios of the red color R(X), the green color G(Y) and the blue color B(Z) with respect to full 255 gray level of red 255 gray level (R255), green 255 gray level (G255) and blue 255 gray level (G255) are 22%, 54% and 28% respectively.

To compare the curves in the FIGS. 3 and 4, it is easily to find that the gray level ratios of the red color R(X), the green color G(Y) and the blue color B(Z) in the conduction of front viewing angle are different with the conduction of wide viewing angle and the brightness ratio of green color G(Y) under the wide viewing angle is relatively smaller. Therefore, in the conduction of wide viewing angle the brightness ratio of the red color R(X) and the blue color B(Z) relate to the brightness ratio of the green color G(Y) cannot be ignored, because of the chromaticity of green color in the conduction of wide viewing angle is obviously resulting in color shift.

Figure 5:
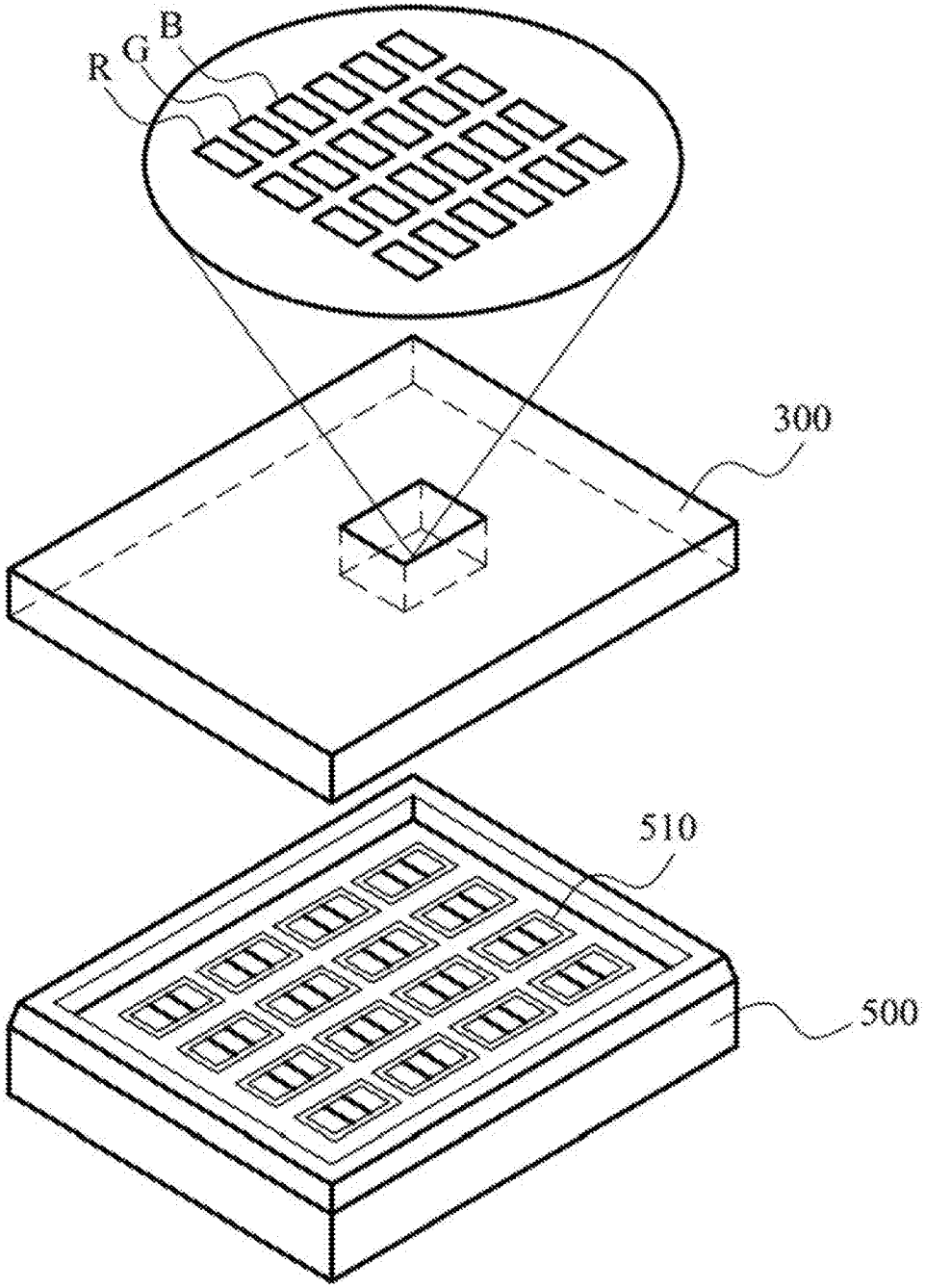
FIG. 5 is a schematic view showing the pixels arrangement used in a driving device with use of a display apparatus according to another embodiment of the present invention.

FIG. 5 is a schematic view showing the pixels arrangement used in a driving device 500 with use of a display apparatus 300 according to another embodiment of the present invention. The driving device 500 with use of the display apparatus 300 includes a plurality of pixel units 510, each of the pixel units 510 includes a red sub-pixel, a green sub-pixel, and a blue sub-pixel. Each of the pixel units is used to receive and to present an image signal. In the present invention, the screen of the liquid crystal display panel is divided into a plurality of division areas. Moreover, each of the division areas is composited of a plurality of pixel units and the size of the division area can be defined by designer.

The driving device of the present invention comprises average value of signals computing means configured to calculate the average image signals of sub-pixels of a division area to generate an average value of red color signals of the division area, an average value of green color signals of the division area, and an average value of blue color signals of the division area; then, gamma signal transforming means configured to execute a red color gamma adjustment and blue color gamma adjustment respectively according to a predefined frame determining with the corresponding a plurality of gray levels of the average value of red color signals of the division area, the average value of green color signals of the division area, and the average value of blue color signals of the division area; and brightness adjusting means configured to adjust the brightness of a red light source and the brightness of a blue light source respectively. With such configuration, the color shift of the liquid crystal panel may be reduced. Furthermore, the image output from the driving device with use of the display apparatus according to the present embodiment dynamically changes the brightness of the backlight in accordance with the inputted image, and suppresses the color shift even if the transmittance of the image output element is changed, whereby a desired color can be realized.

Figure 6:
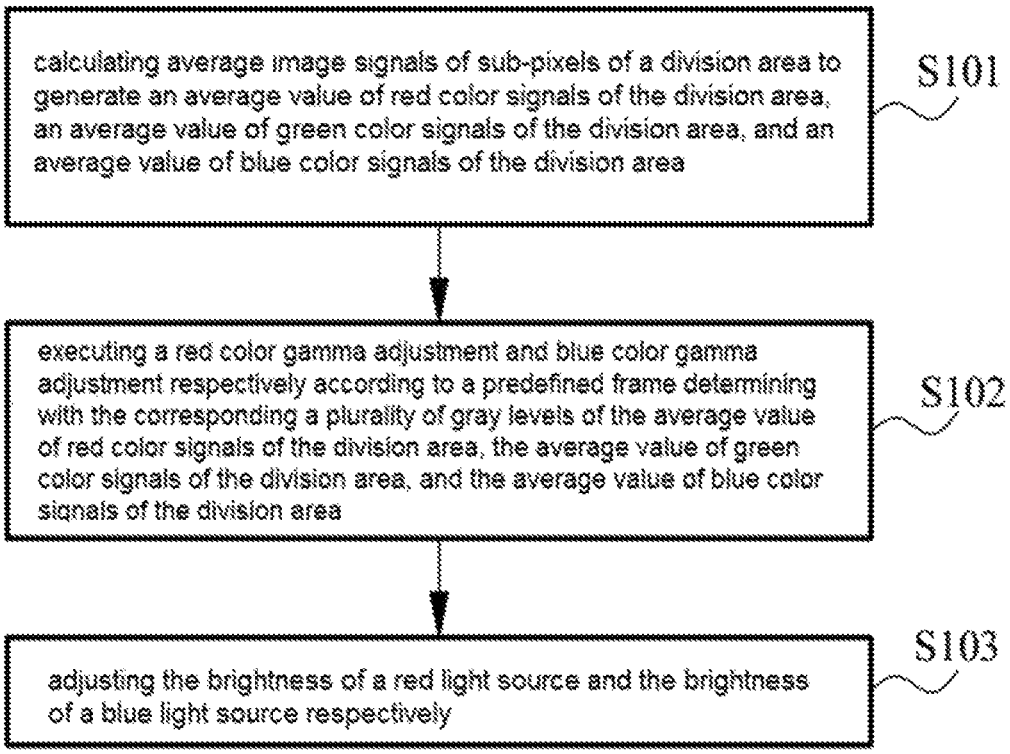
FIG. 6 is a flowchart illustrating a driving method for a display apparatus according to one embodiment of the present invention.

FIG. 6 is a flowchart illustrating a driving method for a display apparatus according to one embodiment of the present invention. The driving method includes the following steps: S101, calculating average image signals of sub-pixels (Rn,m_i,j, Gn,m_i,j, Bn,m_i,j) of a division area (n,m) to generate an average value of red color signals of the division area (Ave_Rn,m), an average value of green color signals of the division area (Ave_Gn,m), and an average value of blue color signals of the division area (Ave_Bn,m), wherein the n and m represents the column and the row of the division area located in the display panel and the i and j represents the column and row of the sub-pixel located within the division area; S102, executing a red color gamma adjustment and blue color gamma adjustment respectively according to a predefined frame determining with the corresponding a plurality of gray levels of the average value of red color signals of the division area, the average value of green color signals of the division area, and the average value of blue color signals of the division area; and S103, adjusting the brightness of a red light source and the brightness of a blue light source respectively.

For instance, when the gray level of the average value of green color signals of the division area is in the predefined frame from 255 to 200, and the gray level of the average value of red color signals of the division area and the gray level of the average value of blue color signals of the division area is in the predefined frame from 20 to 180, then the red color gamma is adjusted from original gamma R to adjusted gamma R1, the blue color gamma is adjusted from original gamma B to adjusted gamma B1, and the adjusted gamma R1 is greater than original gamma R (γR1>γR) and the adjusted gamma B1 is greater than original gamma B (γB1>γB), where γ represents gamma, R represents red color and B represents blue color.

In one embodiment of the present invention, in the step S102, when the gray level of the average value of green color signals of the division area is in the predefined frame from 200 to 150, and the gray level of the average value of red color signals of the division area and the gray level of the average value of blue color signals of the division area is in the predefined frame from 10 to 180, then the red color gamma is adjusted from original gamma R to adjusted gamma R1, the blue color gamma is adjusted from original gamma B to adjusted gamma B1, and the adjusted gamma R1 is greater than original gamma R (γR1>γR) and the adjusted gamma B1 is greater than original gamma B (γB1>γB), where γ represents gamma, R represents red color and B represents blue color.

In one embodiment of the present invention, in the step S102, when the gray level of the average value of green color signals of the division area is in the predefined frame from 150 to 100, and the gray level of the average value of red color signals of the division area and the gray level of the average value of blue color signals of the division area is in the predefined frame from 10 to 140, then the red color gamma is adjusted from original gamma R to adjusted gamma R1, the blue color gamma is adjusted from original gamma B to adjusted gamma B1, and the adjusted gamma R1 is greater than original gamma R (γR1>γR) and the adjusted gamma B1 is greater than original gamma B (γB1>γB), where γ represents gamma, R represents red color and B represents blue color.

In one embodiment of the present invention, in the step S102, when the gray level of the average value of green color signals of the division area is in the predefined frame from 100 to 50, and the gray level of the average value of red color signals of the division area and the gray level of the average value of blue color signals of the division area is in the predefined frame from 10 to 80, then the red color gamma is adjusted from original gamma R to adjusted gamma R1, the blue color gamma is adjusted from original gamma B to adjusted gamma B1, and the adjusted gamma R1 is greater than original gamma R (γR1>γR) and the adjusted gamma B1 is greater than original gamma B (γB1>γB), where γ represents gamma, R represents red color and B represents blue color.

In one embodiment of the present invention, in the step S102, when the gray level of the average value of green color signals of the division area is in the predefined frame from 50 to 0, and the gray level of the average value of red color signals of the division area and the gray level of the average value of blue color signals of the division area is in the predefined frame from 10 to 40, then the red color gamma is adjusted from original gamma R to adjusted gamma R1, the blue color gamma is adjusted from original gamma B to adjusted gamma B1, and the adjusted gamma R1 is greater than original gamma R (γR1>γR) and the adjusted gamma B1 is greater than original gamma B (γB1>γB), where α represents gamma, R represents red color and B represents blue color.

In the foregoing embodiments, the red and blue gamma are increased after adjustment and the brightness of the corresponding red gray level and the blue grey level are declined consequently, and the brightness declined calculation formula is as follows:

$$L'R(g)=LR(255)*(g/255)^{\gamma R1},\ and\ L'B(g)=LB(255)*(g/255)^{\gamma B1},$$

where L represents the brightness before adjusting, L' represents the brightness after the red or blue gamma adjustment, g represents any gray level, R represents red color and B represents blue color.

The present invention also provides another driving method for a display apparatus. Referring to FIG. 5, when the display apparatus adopts the direct-type LED backlight, the backlight accompanied by the screen of the liquid crystal display panel is divided into a plurality of division areas and each of the plurality of division areas may express with columns (n) multiplied by rows (M). Each of the division areas is provided with an independent red color, green color and blue color LED light source controlling signal.

In order to compensate for the increase in red gamma and blue gamma from the original γR, γB adjusted to γR1, γB1, where γR1>γR, γB1>γB, the declined brightness of the corresponding red gray level and blue gray level caused by those gamma adjustments can be calculated by the formula as follows:

$$L'R(g)=LR(255)*(g/255)^{\gamma R1},\ and\ L'B(g)=LB(255)*(g/255)^{\gamma B1},$$

where L represents the brightness before adjusting, L' represents the brightness after the red or blue gamma adjustment, g represents any gray level, R represents red color and B represents blue color.

Furthermore, the brightness of the red light source is adjusted according to the following equation:

$$A'n,m_R/An,m_R=LR(Ave_Rn,m)/L'R(Ave_Rn,m)=LR(255)*(Ave_Rn,m/255)^{\gamma R}/LR(255)*(Ave_Rn,m/255)^{\gamma R1},$$

where A'n,m_R represents the brightness signal of the red light source after the red gamma adjustment, An,m_R represents the initial brightness signal of the red light source, Ave_Rn,m represents the average value of red color signals of all red sub-pixels in the division area, and n and m represents the column and the row of the division area located in the display panel.

And accordingly, the brightness of the blue light source is adjusted according to the following equation:

$$A'n,m_B/An,m_B=LB(Ave_Bn,m)/L'B(Ave_Bn,m)=LB(255)*(Ave_Bn,m/255)^{\gamma B}/LB(255)*(Ave_Bn,m/255)^{\gamma B1},$$

where A'n,m_B represents the brightness signal of the blue light source after the red gamma adjustment, An,m_B represents the initial brightness signal of the blue light source, Ave_Bn,m represents the average value of blue color signals of all blue sub-pixels in the division area, and n and m represents the column and the row of the division area located in the display panel.

In the present embodiment, by using the compensation signal to adjust the brightness of a red light source and the brightness of a blue light source respectively, it can enable the chromaticity under the front viewing angle to maintain the same as under the front viewing angle, and consequently the original color expression cannot be influenced due to the adjustment of the red color gamma signal and the blue color gamma signal. With such configuration, the color shift of the liquid crystal panel may be reduced.

The present invention further provides a display apparatus 700 comprising a liquid crystal display panel 710 and the driving device 500 configured to transmit the image signals to the liquid crystal display panel 710 as aforementioned.

The display apparatus 700 adopts the driving method and driving device making the same of the present invention, wherein the driving method is used to eliminate the color shift mainly caused by the chromaticity of green gray level under the wide viewing angle. The driving method includes calculating average image signals of sub-pixels of a division area to generate an average value of red color signals of the division area, an average value of green color signals of the division area, and an average value of blue color signals of the division area. And then, executing a red color gamma adjustment and blue color gamma adjustment respectively according to a predefined frame determining with the corresponding a plurality of gray levels of the average value of red color signals of the division area, the average value of green color signals of the division area, and the average value of blue color signals of the division area. Thereby, the red color and blue color input gamma signals are adjusted to be enlarged, so that the brightness ratio of red color and blue color relative to green color under the wide view angle prospect is further declined. Therefore, the green color hue under the wide view angle prospect is enhanced. Furthermore, by using the compensation signal to adjust the brightness of a red light source and the brightness of a blue light source respectively, it can enable the chromaticity under the front viewing angle to maintain the same, without color shift, and consequently the original color expression cannot be influenced due to the adjustment of the red color gamma signal and the blue color gamma signal. With such configuration, the color shift of the liquid crystal panel may be reduced. Therefore, to maintain the original signal and having the same color performance can be achieved, also to keep an excellent viewing angle characteristic in the green color is enhanced at the same time.

In addition, in the specification, unless explicitly described to the contrary, the word "comprise" and variations such as "comprises" or "comprising" will be understood to imply the inclusion of stated elements but not the exclusion of any other elements.

The present invention has been described with a preferred embodiment thereof and it is understood that many changes and modifications to the described embodiment can be carried out without departing from the scope and the spirit of the invention that is intended to be limited only by the appended claims.

What is claimed is:

1. A driving method for a display apparatus, comprising a liquid crystal display panel with a plurality of pixel units having a red sub-pixel, a green sub-pixel, and a blue sub-pixel, the driving method comprising following steps:

calculating average image signals of sub-pixels of a division area to generate an average value of red color signals of the division area, an average value of green color signals of the division area, and an average value of blue color signals of the division area;

executing a red color gamma adjustment and a blue color gamma adjustment respectively according to a predefined frame determining with the corresponding a plurality of gray levels of the average value of red color signals of the division area, the average value of green color signals of the division area, and the average value of blue color signals of the division area; and adjusting a red light source and a brightness of a blue light source respectively;

wherein when the gray level of the average value of green color signals of the division area is in a first gray value of the predefined frame and, the gray level of the average value of red color signals of the division area and the gray level of the average value of blue color signals of the division area are in a second gray value of the predefined frame, the red color gamma is adjusted from original $\gamma R$ to adjusted $\gamma R1$, the blue color gamma is adjusted from original $\gamma B$ to adjusted $\gamma B1$, and the adjusted $\gamma R1$ is greater than original $\gamma R$ ($\gamma R1>\gamma R$) and the adjusted $\gamma B1$ is greater than original $\gamma B$ ($\gamma B1>\gamma B$), where $\gamma$ represents gamma, R represents red color and B represents blue color.

2. The driving method with use of a display device according to claim 1, wherein the first gray value and the second gray value of the predefined frame are selected from one of following groups:

a first group including the first gray value in a range of 255 to 200 and the second gray value in a range of 20 to 180;

a second group including the first gray value in a range of 200 to 150 and the second gray value in a range of 10 to 180;

a third group including the first gray value in a range of 150 to 100 and the second gray value in a range of 10 to 140;

a fourth group including the first gray value in a range of 100 to 50 and the second gray value in a range of 10 to 80; and a fifth group including the first gray value in a range of 50 to 0 and the second gray value in a range of 10 to 40.

3. The driving method with use of a display device according to claim 1, wherein the red and blue gamma are increased after adjustment and the brightness of the corresponding red gray level and the blue grey level are exhibited according to a declined calculation formula as:

$$L'R(g)=LR(255)*(g/255)^{\gamma R1}, \text{ and}$$

$$L'B(g)=LB(255)*(g/255)^{\gamma B1},$$

where L represents the brightness before adjusting, L' represents the brightness after the red or blue gamma adjustment, g represents gray level, R represents red color and B represents blue color.

4. The driving method with use of a display device according to claim 3, wherein the g gray level is any value of the gray level.

5. The driving method with use of a display device according to claim 3, wherein the brightness of the red light source is adjusted according to the following equation:

$$A'n,m_R/An,m_R=LR(Ave_Rn,m)/L'R(Ave_Rn,m)=$$

$$LR(255)*(Ave_Rn,m/255)^{\gamma R}/LR(255)*(Ave_Rn,m/255)^{\gamma R1},$$

where A'n,m_R represents the brightness signal of the red light source after the red gamma adjustment, An,m_R represents the initial brightness signal of the red light source, Ave_Rn,m represents the average value of red color signals of all red sub-pixels in the division area, and n and m represents the column and the row of the division area located in the display panel.

6. The driving method with use of a display device according to claim 3, wherein the brightness of the blue light source is adjusted according to the following equation:

$$A'n,m_B/An,m_B=LB(Ave_Bn,m)/L'B(Ave_Bn,m)=$$

$$LB(255)*(Ave_Bn,m/255)^{\gamma B}/LB(255)*(Ave_Bn,m/255)^{\gamma B1},$$

where A'n,m_B represents the brightness signal of the blue light source after the red gamma adjustment, An,m_B represents the initial brightness signal of the blue light source, Ave_Bn,m represents the average value of blue color signals of all blue sub-pixels in the division area, and n and m represents the column and the row of the division area located in the display panel.

7. A driving device with use of a display apparatus comprising a liquid crystal display panel, the liquid crystal display panel including at least one division area composited of a plurality of pixel units, each of the plurality of pixel units comprising a red sub-pixel, a green sub-pixel, and a blue sub-pixel, the driving device comprising:

an average value of signals computing means, configured to calculate average image signals of sub-pixels of a division area to generate an average value of red color signals of the division area, an average value of green color signals of the division area, and an average value of blue color signals of the division area;

a gamma signal transforming means, configured to execute a red color gamma adjustment and blue color gamma adjustment respectively according to a predefined frame determining with corresponding a plurality of gray levels of the average value of red color signals of the division area, the average value of green color signals of the division area, and the average value of blue color signals of the division area; and a brightness adjusting means, configured to adjust a brightness of a red light source and a brightness of a blue light source respectively;

wherein when the gray level of the average value of green color signals of the division area is in a first gray value of the predefined frame and, the gray level of the average value of red color signals of the division area and the gray level of the average value of blue color signals of the division area are in a second gray value of the predefined frame, the red color gamma is adjusted from original γR to adjusted γR1, the blue color gamma is adjusted from original γB to adjusted γB1, and the adjusted γR1 is greater than original γR (γR1>γR) and the adjusted γB1 is greater than original γB (γB1>γB), where γrepresents gamma, R represents red color and B represents blue color.

8. The driving device with use of a display apparatus according to claim 7, wherein the first gray value and the second gray value of the predefined frame are selected from one of the following groups:

a first group including the first gray value in a range of 255 to 200 and the second gray value in a range of 20 to 180;

a second group including the first gray value in a range of 200 to 150 and the second gray value in a range of 10 to 180;

a third group including the first gray value in a range of 150 to 100 and the second gray value in a range of 10 to 140;

a fourth group including the first gray value in a range of 100 to 50 and the second gray value in a range of 10 to 80;

a fifth group including the first gray value in a range of 50 to 0 and the second gray value in a range of 10 to 40.

9. The driving device with use of a display apparatus according to claim 8, wherein the red and blue gamma are increased after adjustment and the brightness of the corresponding red gray level and the blue grey level are exhibited according to a declined calculation formula as:

$$L'R(g)=LR(255)*(g/255)^{\gamma R1}, \text{ and}$$

$$L'B(g)=LB(255)*(g/255)^{\gamma B1},$$

where L represents the brightness before adjusting, L' represents the brightness after the red or blue gamma adjustment, g represents gray level, R represents red color and B represents blue color.

10. The driving device with use of a display apparatus according to claim 8, wherein the brightness of the red light source is adjusted according to the following equation:

$$A'n,m_R/An,m_R=LR(Ave_Rn,m)/L'R(Ave_Rn,m)=$$

$$LR(255)*(Ave_Rn,m/255)^{\gamma R}/LR(255)*(Ave_Rn,m/255)^{\gamma R1},$$

where A'n,m_R represents the brightness signal of the red light source after the red gamma adjustment, An,m_R represents the initial brightness signal of the red light source, Ave_Rn,m represents the average value of red color signals of all red sub-pixels in the division area, and n and m represents the column and the row of the division area located in the display panel.

11. The driving device with use of a display apparatus according to claim 8, wherein the brightness of the blue light source is adjusted according to the following equation:

$$A'n,m_B/An,m_B=LB(Ave_Bn,m)/L'B(Ave_Bn,m)=$$

$$LB(255)*(Ave_Bn,m/255)^{\gamma B}/LB(255)*(Ave_Bn,m/255)^{\gamma B1},$$

where A'n,m_B represents the brightness signal of the blue light source after the red gamma adjustment, An,m_B represents the initial brightness signal of the blue light source, Ave_Bn,m represents the average value of blue color signals of all blue sub-pixels in the division area, and n and m represents the column and the row of the division area located in the display panel.

12. A display apparatus, comprising:

a liquid crystal display panel, including at least one division area composited of a plurality of pixel units and each of the plurality of pixel units further comprising a red sub-pixel, a green sub-pixel, and a blue sub-pixel; and a driving device, comprising:

an average value of signals computing means, configured to calculate average image signals of sub-pixels of a division area to generate an average value of red color signals of the division area, an average value of green color signals of the division area, and an average value of blue color signals of the division area;

a gamma signal transforming means, configured to execute a red color gamma adjustment and blue color gamma adjustment respectively according to a predefined frame determining with the corresponding a plurality of gray levels of the average value of red color signals of the division area, the average value of green color signals of the division area, and the average value of blue color signals of the division area; and a brightness adjusting means, configured to adjust a brightness of a red light source and a brightness of a blue light source respectively;

wherein when the gray level of the average value of green color signals of the division area is in a first gray value of the predefined frame and, the gray level of the average value of red color signals of the division area and the gray level of the average value of blue color signals of the division area are in a second gray value of the predefined frame, the red color gamma is adjusted from original γR to adjusted γR1, the blue color gamma is adjusted from original γB to adjusted γB1, and the adjusted γR1 is greater than original γR (γR1>γR) and the adjusted γB1 is greater than original γB (γB1>γB), where γrepresents gamma, R represents red color and B represents blue color.

13. The display apparatus according to claim 12, wherein the first gray value and the second gray value of the predefined frame are selected from one of following groups:

a first group including the first gray value in a range of 255 to 200 and the second gray value in a range of 20 to 180;

a second group including the first gray value in a range of 200 to 150 and the second gray value in a range of 10 to 180;

a third group including the first gray value in a range of 150 to 100 and the second gray value in a range of 10 to 140;

a fourth group including the first gray value in a range of 100 to 50 and the second gray value in a range of 10 to 80;

a fifth group including the first gray value in a range of 50 to 0 and the second gray value in a range of 10 to 40.

14. The display apparatus according to claim 13, wherein the red and blue gamma are increased after adjustment and the brightness of the corresponding red gray level and the blue grey level are exhibited according to a declined calculation formula as:

$$L'R(g)=LR(255)*(g/255)^{\gamma R}1, \text{ and } L'B(g)=LB(255)*(g/255)^{\gamma B1},$$

where L represents the brightness before adjusting, L' represents the brightness after the red or blue gamma adjustment, g represents any gray level, R represents red color and B represents blue color.

15. The display apparatus according to claim 13, wherein the brightness of the red light source is adjusted according to the following equation:

$$A'n,m_R/An,m_R=LR(Ave_Rn,m)/L'R(Ave_Rn,m)=LR(255)*(Ave_Rn,m/255)^{\gamma R}/LR(255)*(Ave_Rn,m/255)^{\gamma R1},$$

where A'n,m_R represents the brightness signal of the red light source after the red gamma adjustment, An,m_R represents the initial brightness signal of the red light source, Ave_Rn,m represents the average value of red color signals of all red sub-pixels in the division area, and n and m represents the column and the row of the division area located in the display panel.

16. The display apparatus according to claim 13, wherein the brightness of the blue light source is adjusted according to the following equation:

$$A'n,m_B/An,m_B=LB(Ave_Bn,m)/L'B(Ave_Bn,m)=LB(255)*(Ave_Bn,m/255)^{\gamma B}/LB(255)*(Ave_Bn,m/255)^{\gamma B1},$$

where A'n,m_B represents the brightness signal of the blue light source after the red gamma adjustment, An,m_B represents the initial brightness signal of the blue light source, Ave_Bn,m represents the average value of blue color signals of all blue sub-pixels in the division area, and n and m represents the column and the row of the division area located in the display panel.

17. The display apparatus according to claim 12, wherein the driving device transmits the image signals to the liquid crystal display panel.

* * * * *